US009101235B2

(12) United States Patent
Yu

(10) Patent No.: US 9,101,235 B2
(45) Date of Patent: Aug. 11, 2015

(54) THERAPEUTIC CUSTOM ROLL PILLOW

(71) Applicant: Chang Jun Yu, Mount Prospect, IL (US)

(72) Inventor: Chang Jun Yu, Mount Prospect, IL (US)

( * ) Notice: Subject to any disclaimer, the term of this patent is extended or adjusted under 35 U.S.C. 154(b) by 0 days.

(21) Appl. No.: 14/504,991

(22) Filed: Oct. 2, 2014

(65) Prior Publication Data

US 2015/0096124 A1 Apr. 9, 2015

Related U.S. Application Data

(60) Provisional application No. 61/886,308, filed on Oct. 3, 2013.

(51) Int. Cl.
*A47G 9/10* (2006.01)

(52) U.S. Cl.
CPC ..... *A47G 9/1081* (2013.01); *A47G 2009/1018* (2013.01)

(58) Field of Classification Search
CPC A47G 9/10; A47G 9/1081; A47G 2009/1018
USPC ..... 5/636, 639, 640, 644, 645, 491
See application file for complete search history.

(56) References Cited

U.S. PATENT DOCUMENTS

| | | | | |
|---|---|---|---|---|
| 2,013,481 | A * | 9/1935 | Stonehill | 5/640 |
| 3,842,453 | A * | 10/1974 | Redfield | 5/643 |
| 4,756,035 | A * | 7/1988 | Beier | 5/640 |
| 5,572,757 | A | 11/1996 | O'Sullivan | |
| 5,758,375 | A | 6/1998 | Horowitz | |
| 5,904,406 | A * | 5/1999 | Stewart | 297/397 |
| 6,449,788 | B1 | 9/2002 | Nichols | |
| 6,513,179 | B1 * | 2/2003 | Pan | 5/636 |
| 6,823,546 | B1 * | 11/2004 | Hsu | 5/636 |
| 7,188,382 | B1 * | 3/2007 | Taylor et al. | 5/648 |
| 2002/0078507 | A1 * | 6/2002 | Pearce | 5/644 |
| 2005/0198738 | A1 * | 9/2005 | Hedges | 5/636 |
| 2006/0042008 | A1 | 3/2006 | Baker | |
| 2011/0252567 | A1 | 10/2011 | Yu | |

FOREIGN PATENT DOCUMENTS

| | | | | |
|---|---|---|---|---|
| FR | 2921240 A1 * | 3/2009 | | A47C 31/10 |
| WO | WO 2009038278 A1 * | 3/2009 | | A47G 9/10 |

OTHER PUBLICATIONS

International Search Report for PCT/US2014/058875 dated Jan. 6, 2015.

* cited by examiner

*Primary Examiner* — Michael Trettel
(74) *Attorney, Agent, or Firm* — Greer, Burns & Crain, Ltd.

(57) ABSTRACT

A support device includes a substantially cylindrical body having a first elongated body portion and a second elongated body portion. Each body portion has a generally semi-cylindrical shape, interfacing along a longitudinal plane. An inner cavity is disposed on an inner surface of each of the first and second body portions, and is dimensioned for receiving at least one removable and adjustable insert, such that each insert is adjustable and positionable for conforming to a profile of a body of a user. The adjustable insert is movable within the cavity for altering the support of the cylindrical body for the user.

25 Claims, 19 Drawing Sheets

THERAPEUTIC CUSTOM ROLL PILLOW

CROSS-REFERENCE

This application claims priority of U.S. Provisional Application Ser. No. 61/886,308, filed Oct. 3, 2013 under 35 U.S.C. §119(e), which is incorporated herein by reference.

BACKGROUND

The present device generally relates to support devices, and particularly support devices. More specifically, the device relates to a customizable therapeutic support device used for sleeping or exercises, also known in the industry as a "roll pillow."

Physical therapy is a well-established branch of medicine and has developed as a useful means for helping people with specific physical issues function at a higher level. A physical therapist works with a patient using specifically prescribed exercises to, among other things, improve range of motion, reduce pain and swelling, and strengthen muscles.

Often, during such exercises or sleeping, it is important to properly support certain areas of the patient's appendages. To achieve the proper support, the therapist utilizes numerous pillows, pads, and the like. However, when it comes to supporting a patient's body, such as the head and neck, one-sized support certainly does not work for all patients having differently sized body parts. In fact, when it comes to supporting the most vital appendage of the human body, such as the head and neck areas, many factors, such as contour, density and hardness, vary significantly per each patient. This is well-known that the proper support is important during exercise or sleeping.

A support device is needed that better facilitates exercise or sleeping by individuals with flexibility and/or medical issues of the type described above. Ideally, an improved support device is inherently stable and decreases the pressure felt by the individual by providing a larger contact area or interface between the device and the individual during exercise or sleeping. It is desirable to have a system, which could be adjusted to fit each individual's unique body and support needs. Such a device and the method for using the device provide therapeutic benefits to patients. Chiropractors, physiatrists, orthopedists and physical therapists would especially find the device and methods to be very useful in patient care. Thus, there is a need for developing an improved therapeutic support device having an enhanced configuration that provides reduced strain and personalized fitting regardless of the individual's unique body and support needs.

SUMMARY

The present disclosure is directed to a support device or a therapeutic custom roll pillow constructed and arranged for providing customizable support on the head and neck areas of a user. The present pillow provides orthopedic support, which is customizable for fitting the user's body, needs, and/or preferences without using differently sized pillows. Specifically, the present pillow provides support for the natural contour of the cervical lordosis, but is customizable to fit different body areas and variations in the sizes and preferences of the user.

Typically, the degeneration of neck curvature occurs more from front to back of the cervical spine than from side to side. The user may sleep or rest on his back and on his side, but the user needs different height supports for back sleeping and side sleeping. For example, the pillow should be lower when sleeping on one's back, and higher when sleeping on the side, because when the user sleeps on the side, the head is positioned higher than when resting on his back. Thus, the user needs a higher head support to maintain the straight spinal alignment depending on an orientation of the user's body, e.g., during sleeping on the side. The present pillow supports the neck curve or the natural contour of the cervical lordosis when lying in the supine position. When the user rests on the side, the present pillow provides a higher support, and appropriately supports the head to maintain the straight alignment of the neck without additional adjustments.

As described in greater detail below, the present pillow includes a substantially cylindrical body having two parts, preferably interfacing along a longitudinal plane, and the cylindrical body is formed of a material suitable for supporting an area of a body, where each part defines a portion of a cavity within the body. At least one adjustable insert portion is positioned within the cavity of the body, and is movable and adjustable within the cavity to alter the support of the cylindrical body. Accordingly, the present pillow provides a custom fit for the user that enables at least two different height supports with just one pillow. Using the present pillow, the user obtains support for the head and neck areas in various sleeping positions by moving the head to different areas on the pillow during sleeping or exercise.

In one embodiment, a support device includes a substantially cylindrical body having a first elongated body portion and a second elongated body portion. Each body portion has a generally semi-cylindrical shape, interfacing along a longitudinal plane. An inner cavity is disposed on an inner surface of each of the first and second body portions, and is dimensioned for receiving at least one removable and adjustable insert, such that each insert is adjustable and positionable for conforming to a profile of a body of a user. The at least one adjustable insert is movable within the cavity for altering the support of the cylindrical body for the user.

In another embodiment, a support device includes a substantially cylindrical body having a first elongated body portion and a second elongated body portion. Each body portion has a generally semi-cylindrical shape, interfacing along a longitudinal plane. An inner cavity is disposed on an inner surface of the corresponding body portion, and is dimensioned for receiving at least one removable and adjustable insert, such that each insert is adjustable and positionable for conforming to a profile of a body of a user. The at least one adjustable insert is movable within the cavity for altering the support of the cylindrical body for the user, and the at least one insert has a central opening dimensioned for accommodating insertion of an auxiliary insert.

The foregoing and other aspects and features of the disclosure will become apparent to those of reasonable skill in the art from the following detailed description, as considered in conjunction with the accompanying drawings.

BRIEF DESCRIPTION OF THE DRAWINGS

FIGS. 10E-10I illustrate other variations of the locking mechanism of FIG. 10A;

DETAILED DESCRIPTION

Figure 1A:
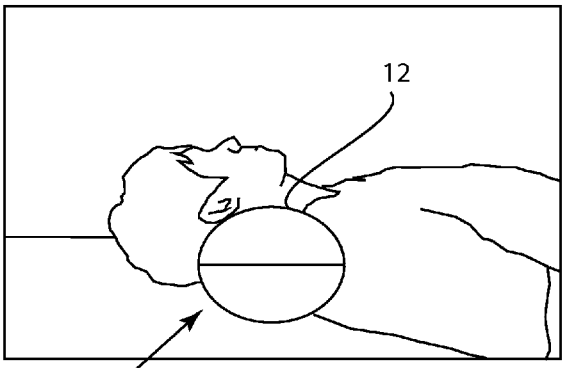
FIGS. 1A-1D illustrate various views of a first embodiment of the present support device as being used and positioned by a user.
Figure 1B:
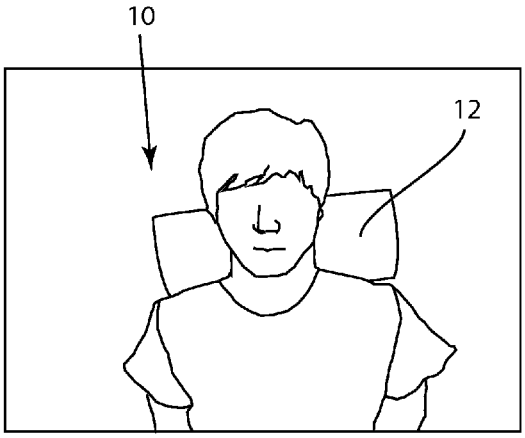
Figure 1C:
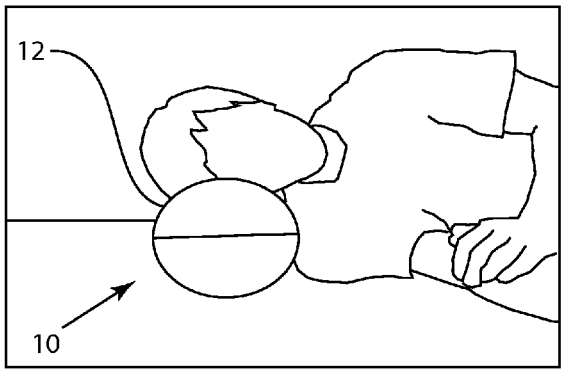
Figure 1D:
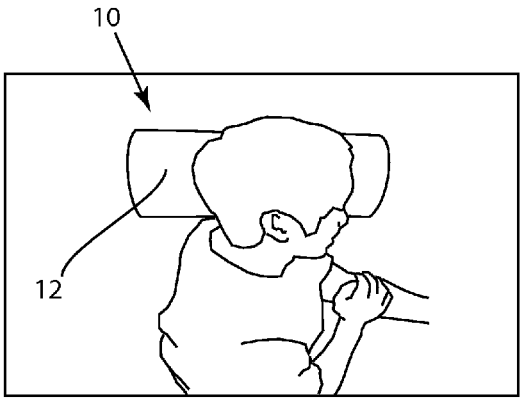

Referring now to FIGS. 1A-1D, an improved support device or a therapeutic custom roll pillow is generally designated 10, and the present support device is used and positioned by a user as illustrated for supporting the neck and head areas of a user in the supine or side lying position. During exercise or sleeping, it is important to properly support a cervical lordotic curve and/or a thoracic spine connected to the neck and head areas of the user for comfort and reinforcement. As shown in FIGS. 1A and 1B, an outer surface 12 of the support device 10 provides back support on the convexity of the thoracic spine, neck, and head areas of the user. Similarly, as shown in FIGS. 1C and 1D, the outer surface 12 provides side support on the spine, neck, and head areas of the user. Although the present support device 10 is shown as supporting the spine, neck, and head areas of the user, it is also contemplated that the device can be used in other areas of the user's body to suit different applications.

Figure 2:
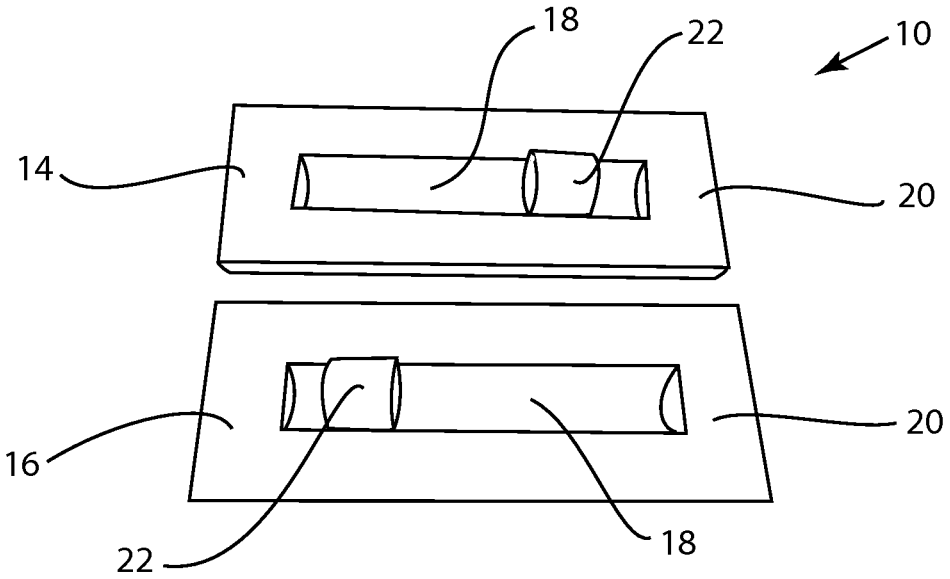
FIG. 2 is a top perspective view of the support device of FIGS. 1A-1D in an open position, illustrating the positioning of two insert portions within an inner cavity of the support device.
Figure 3:
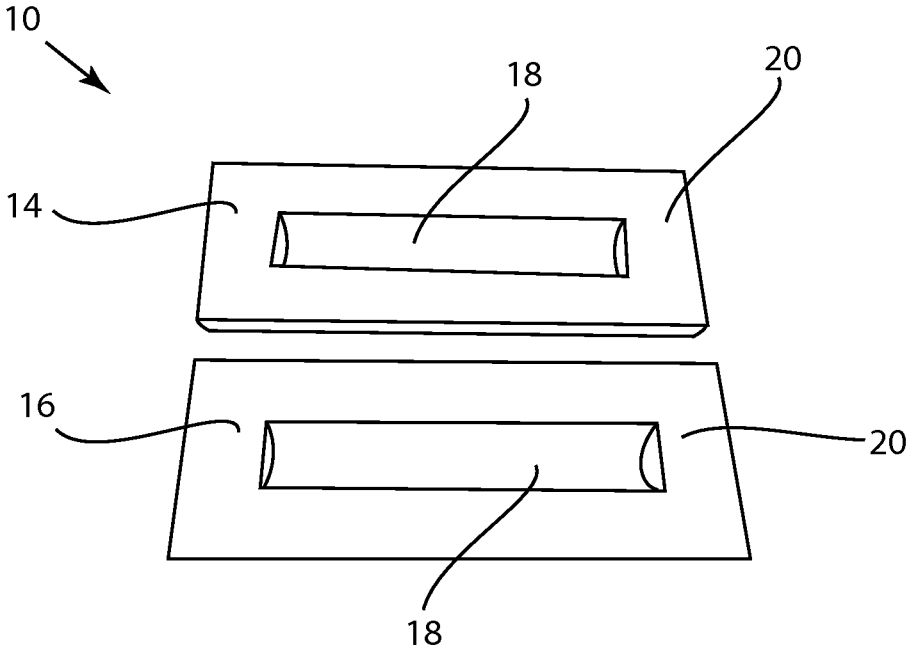
FIG. 3 is a top perspective view of the support device of FIG. 2 in the open position, illustrating the removal of the two insert portions.
Figure 4:
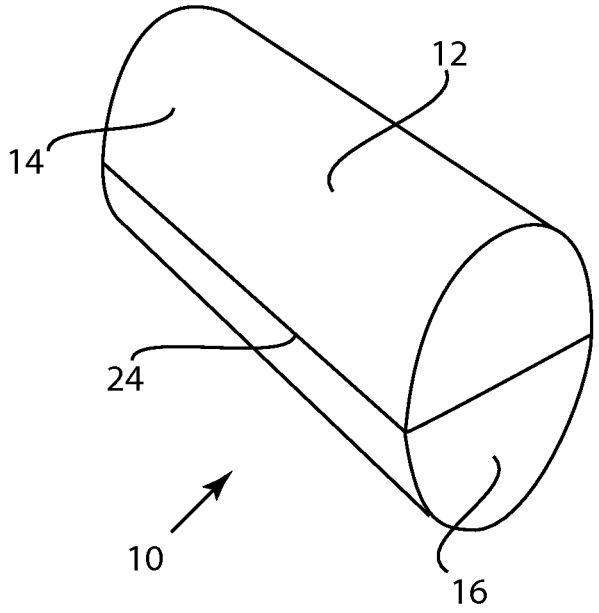
FIG. 4 is a schematic top perspective view of the support device of FIG. 2 in a closed position.

Referring now to FIGS. 2-3, the present support device 10 is shown in an open position. In the preferred embodiment, the present support device 10 has a first elongated body portion 14 and a second elongated body portion 16. Each body portion 14, 16 has a generally semi-cylindrical shape, and includes an inner cavity 18 being disposed on an inner surface 20 of the corresponding body portion 14, 16, and being dimensioned for receiving at least one removable and adjustable insert 22. It is preferred that the inner cavity 18 has a linear or straight orientation along a central longitudinal axis of the corresponding body portion 14, 16, such that the cavities 18 of the body portions 14, 16 are disposed substantially in parallel with each other when the support device 10 is in a closed position (FIG. 4). Each insert 22 is adjustable and positionable for conforming to a profile or contour of a cervical spine of the user, or for satisfying the needs or preferences of the user. Although the semi-cylindrical shape is shown for the body portions 14, 16, and a cubical shape for the inserts 22, other suitable geometric shapes, such as circular, triangular, rectangular, or hexagonal shapes, are also contemplated to suit the application.

It is contemplated that the present support device 10 is made of polyurethane foam, or other similar materials that can be constructed to allow a hole, depression or orifice to be in the body portions 14, 16. The foam or other similar material also functions to provide more support and comfort for the user. In other embodiments, the body portions 14, 16 may be made by using vinyl or other fabric that is filled with buckwheat or other similar materials. Similarly, it is also contemplated that the inserts 22 may be made by using vinyl or other fabric filled with buckwheat or other suitable materials. Preferred embodiments made using a fabric filled with particulate materials may contain the cavity, depression, hole or orifice in the body portions 14, 16 to suit the application. Further, the body portions 14, 16 may be affixed horizontally on one side with fabric adhesive, fabric, or other similar materials that can be used to hold the two head portions together to create a roll pillow.

Returning to FIGS. 1A-1D and 2, as an example only, the inserts 22 control the height of the supporting area when the user sleeps. When the user rests on his supine position (FIG. 1A), the user rests his neck directly in the center of the support device 10, avoiding the inserts 22 (FIG. 1B). The neck rests between the inserts 22, making the device feel lower, and cradle the neck to give proper support in the neck and head areas. When the user sleeps on his side (FIG. 1D), the head width measured from the back of the head to the nose, is typically longer than the neck width. Using the present device 10, the user obtains support for the head and neck areas in various sleeping positions by moving the head to different areas on the device 10 during sleeping or exercise. Therefore, the user's head rests above the inserts 22 and support the head, making the pillow feel higher (FIG. 1C). As a result, the present device 10 supports the user's head in a proper height, and helps maintain a straight alignment of the neck.

Figure 5:
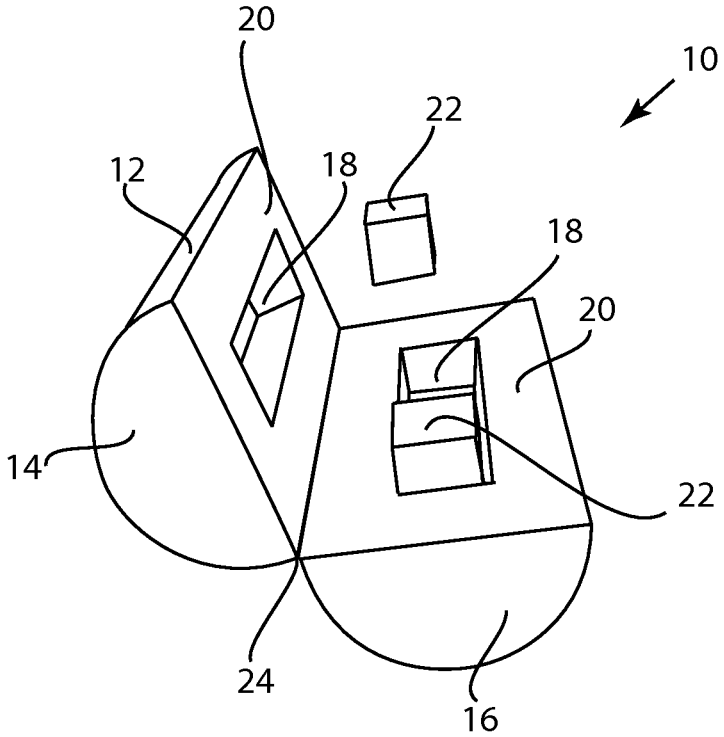
FIG. 5 is a schematic side perspective view of the support device of FIG. 2 in the open position, illustrating possible placement of the two insert portions.
Figure 6:
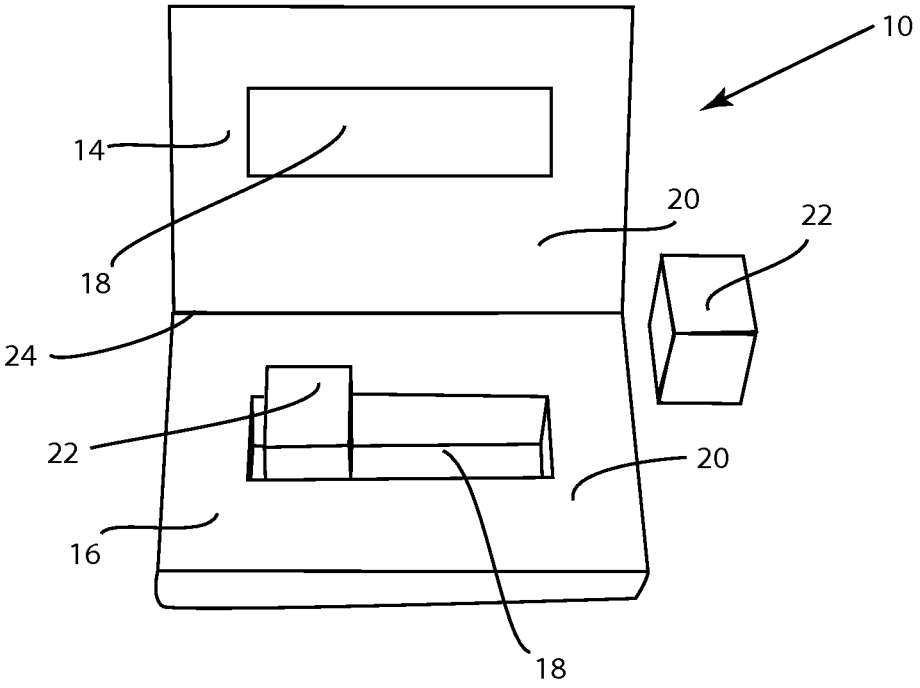
FIG. 6 is a front perspective view of the support device of FIG. 2, illustrating possible placement of the two insert portions.
Figure 7:
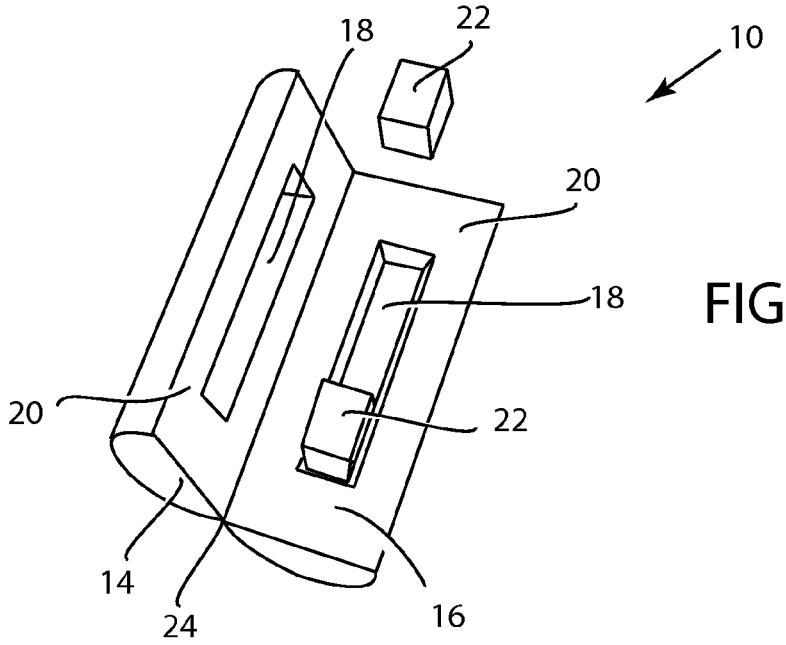
FIG. 7 is a top perspective view of the support device of FIG. 2.

Referring now to FIGS. 4-5, the present support device 10 in a closed position is shown in FIG. 4, and the device in an open position is shown in FIG. 5. In the preferred embodiment, the first and second body portions 14, 16 are assembled together to create a cylindrical shape. For example, the first and second body portions 14, 16 are attached together at a common connection seam 24. Specifically, one longer side of the inner surface 20 of the first body portion 14 is attached substantially parallel to one longer side of the inner surface of the second body portion 16. Two longer sides at the connection seam 24 are hingedly connected together, such that the first and second body portions 14, 16 are rotatable with respect to each other. However, it is contemplated that the first and second body portions 14, 16 are removably attached together using any suitable fastening mechanisms known in the art, such as snaps or hook and loop products. As a result, the body portions 14, 16 are interfaced along a longitudinal plane defined by the inner surfaces 20 of the corresponding body portions.

Referring now to FIGS. 5-8, the present support device 10 in the open position is shown, featuring the inserts 22 being positioned in the cavity 18. As illustrated, the cavity 18 is constructed and arranged to make the body portions 14, 16 more pliable or less stiff as the user locates the neck or head on the support device 10. For example, one or more inserts 22 are positioned in the cavity 18 of the second body portion 16 as per the user's preferences. As the user puts his head on the first body portion 14 (FIGS. 1A-1D), a general shape of the space defined by the cavity 18 changes when the device is compressed, and the cavity is filled by the first and second body portions 14, 16.

Depending on the needs or preferences, the user may selectively add additional inserts 22 in any targeted regions of the cavity 18. It is contemplated that the inserts 22 are preferably tubular, but other suitable shapes, such as cylindrical or other geometric shapes are contemplated to suit the application. It is preferred that the inserts 22 are made of polyurethane foam, but other suitable materials known in the art are also contemplated to fill the cavity 18. For example, two inserts 22 are placed in the cavity 18 according to a width of the user's neck.

Figure 8:
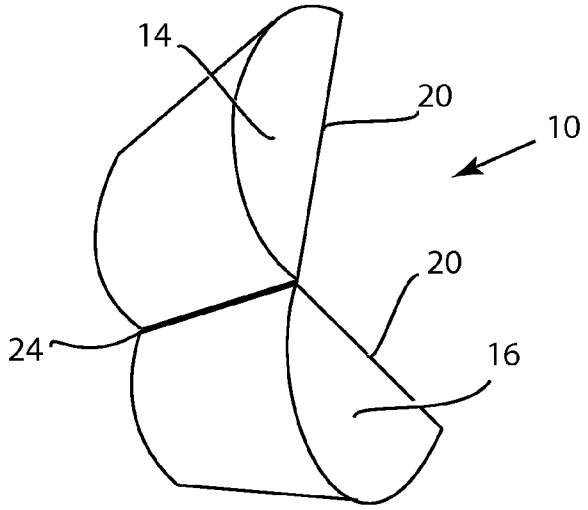
FIG. 8 is a bottom perspective view of the support device of FIG. 2.
Figure 8A:
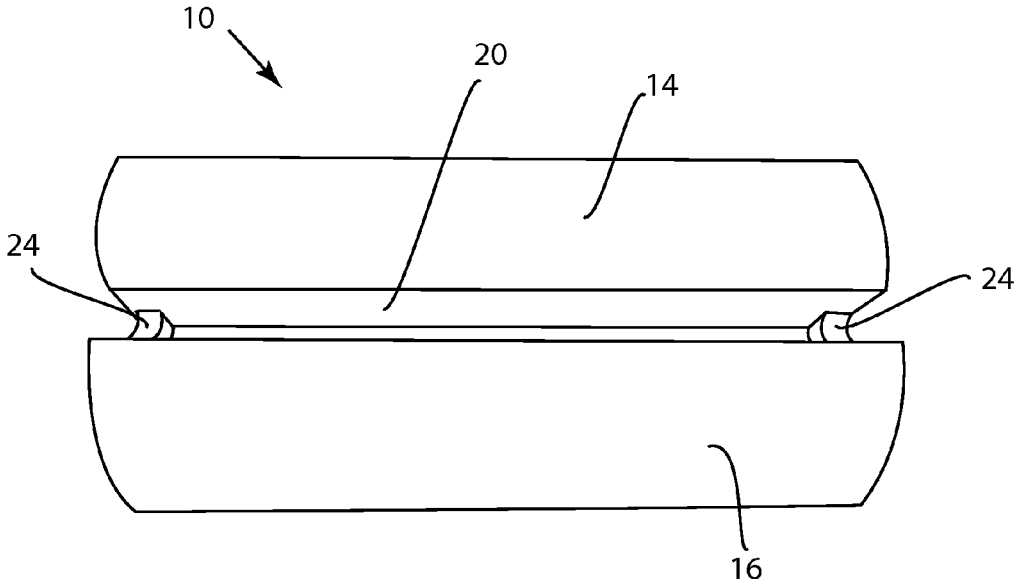
FIG. 8A is a side perspective view of another embodiment of the support device of FIG. 2.
Figure 8B:
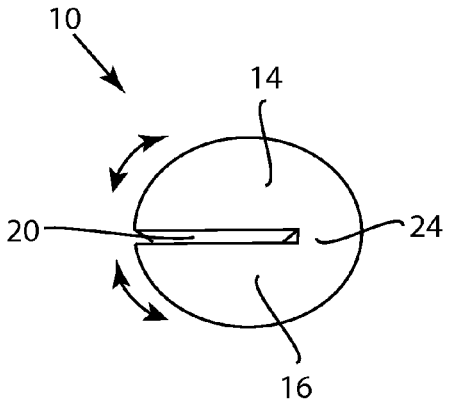
FIG. 8B is a side view of the support device of FIG. 8A.

Referring now to FIGS. 8A and 8B, another embodiment of the present support device 10 is shown, having the common connection seam 24 permanently attached to the body portions 14, 16 on one side. As shown in FIGS. 4-8, two longer sides at the connection seam 24 are hingedly connected together, such that the first and second body portions 14, 16 are rotatable with respect to each other. A notable feature is that the body portions 14, 16 are spaced at a predetermined distance, and flexibly elastically open and close as indicated by an arrow (FIG. 8B), such that the inserts 22 are inserted into the cavities 18 without fully opening the body portions 14, 16 (FIG. 8).

Figure 9A:
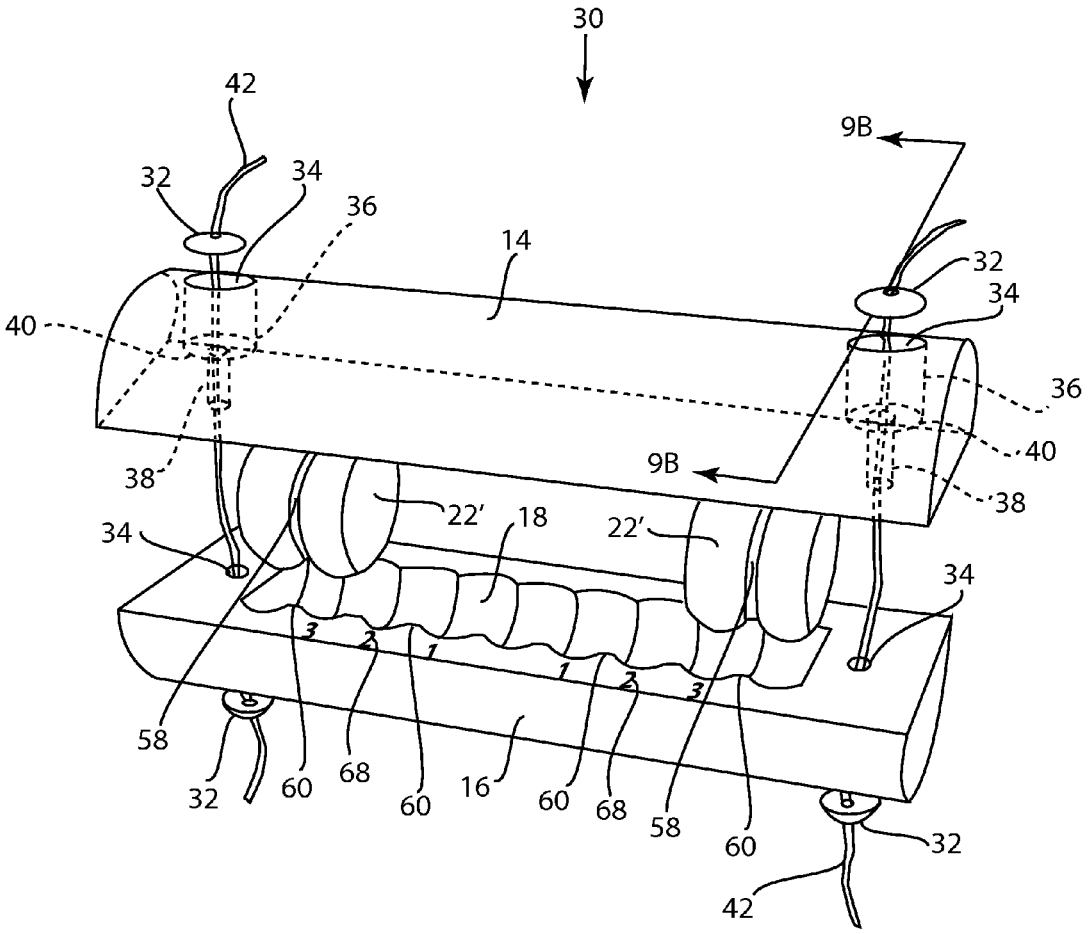
FIG. 9A is an exploded schematic top perspective view of a second embodiment of the present support device, featuring a plurality of locking mechanisms and two insert portions.
Figure 9B:
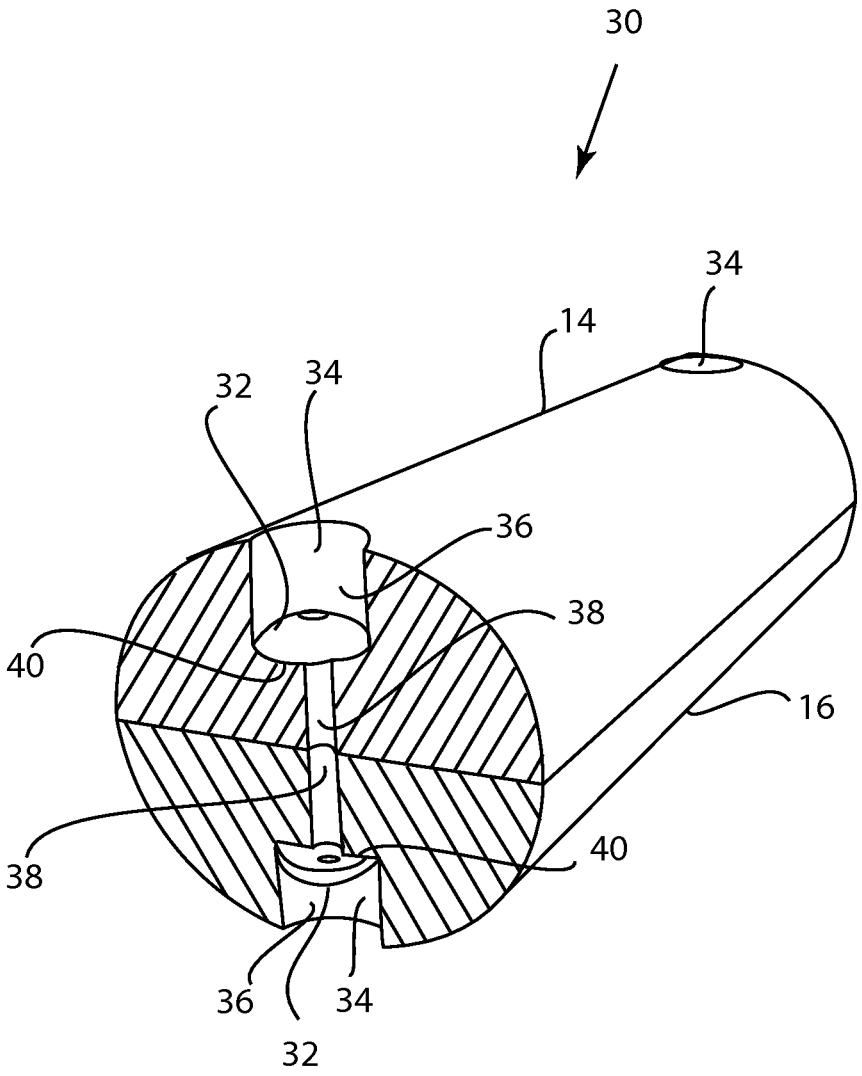
FIG. 9B is a cross-section of the support device in the closed position taken along the line 9B-9B of FIG. 9A and in the direction generally indicated.

Referring now to FIGS. 9A and 9B, another embodiment of the device 10 is generally designated 30. Components shared with the device 10 are designated with identical reference numbers. A major difference featured in the device 30 is that the device includes at least one locking mechanism 32, transitioning between a locked position and an unlocked position, for securely holding the first and second body portions 14, 16 together. At least one insertion opening or bore 34 being generally perpendicular to a longitudinal axis of the device 30 is located on the outer surface 12 of each body portion 14, 16, and is dimensioned for accommodating insertion of the locking mechanism 32 into the corresponding body portion.

Each insertion opening 34 has a first or outer chamber 36 and a second or inner chamber 38, wherein a diameter of the first chamber 36 is larger than the diameter of the second chamber 38. Further, the diameter of the second chamber 38 is smaller than the diameter of the locking mechanism 32, such that the locking mechanism is stopped at a bottom wall 40 of the first chamber 36 when the device 30 is in a locked position (FIG. 9B). An elastic string or rope 42 is provided to hold the locking mechanisms 32 together with the body portions 14, 16 sandwiched between. For example, as described in greater detail below, the string 42 is inserted into the locking mechanism 32 and the insertion opening 34 of the first body portion 14, and then is inserted into the insertion opening 34 and the locking mechanism 32 of the second body portion 16. When two opposite ends of the string 42 are locked by the locking mechanisms 32, the first and second body portions 14, 16 are securely held together under the tensile elongation force of the elastic string between the first and second body portions. It is also contemplated that the locking mechanism 32 can be used in other similar or suitable articles for securing the string or rope 42, such as for tightly tying a shoelace or a garment string in clothing.

Figure 10A:
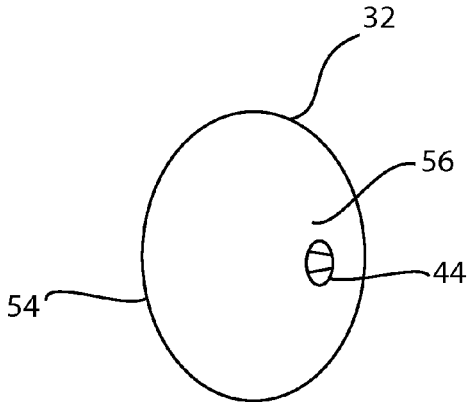
FIG. 10A is a top perspective view of the locking mechanism of FIG. 9 having a central opening.

Referring now to FIGS. 10A-10E, an exemplary operational sequence of the locking mechanism 32 is illustrated. As shown in FIG. 10A, it is contemplated that the locking mechanism 32 has at least one opening 44, preferably located in a center, and dimensioned for receiving the string 42 (shown in phantom). A plurality of flexing protrusion sections 46 (FIGS. 10B and 10D), preferably at least two, are provided on an inner surface 48 of the locking mechanism 32 for locking and unlocking the string 42. Further, the protrusion sections 46 are separated and surrounded by one or more channels or grooves 49. Each protrusion section 46 has a first or inner end 50 adjacent the opening 44, and an opposite second or outer end 52 adjacent a peripheral edge 54 of the locking mechanism 32.

Figure 10B:
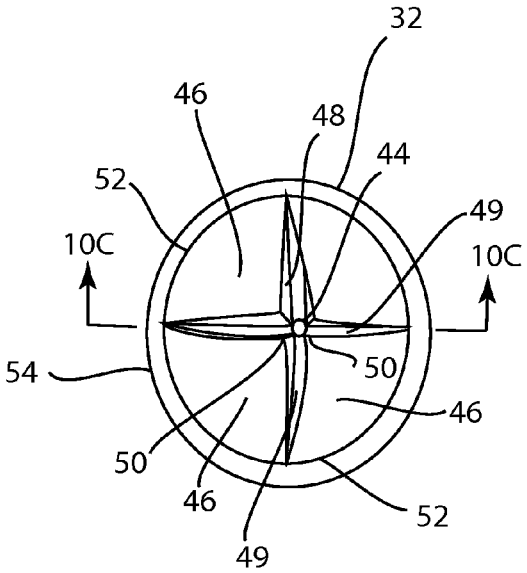
FIG. 10B is a bottom perspective view of the locking mechanism in a locked position.
Figure 10C:
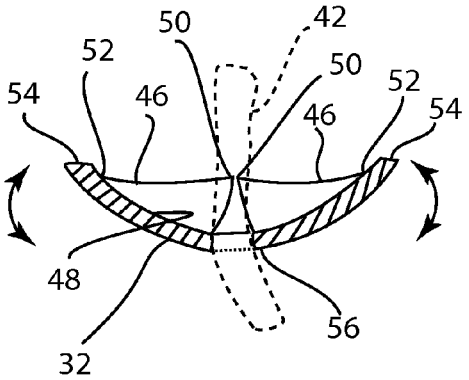
FIG. 10C is a cross-section of the locking mechanism in the locked position taken along the line 10C-10C of FIG. 10B and in the direction generally indicated.

An important feature of each protrusion section 46 is that the first end 50 has a thickness being greater than that of the second end 52. Also, the first end 50 extends from the inner surface 48 near the opening 44 toward a central axis of the opening, such that the first ends of the protrusion sections 46 jointly compress toward the central axis of the opening and securely hold the string 42 when the locking mechanism 32 is in a locked position (FIG. 10C).

Figure 10D:
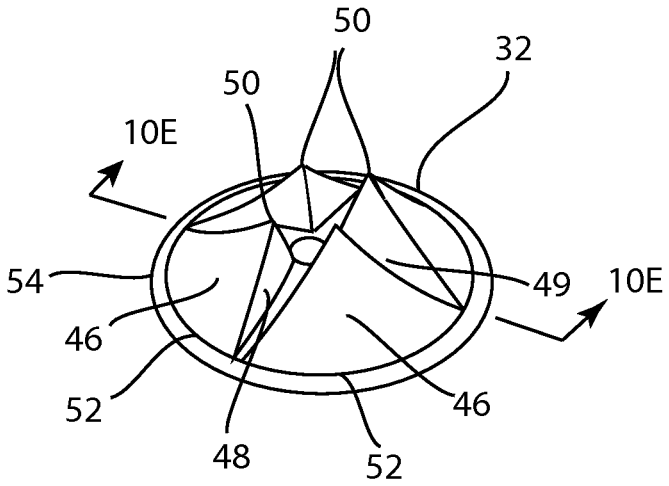
FIG. 10D is a bottom perspective view of the locking mechanism in an unlocked position.
Figure 10E:
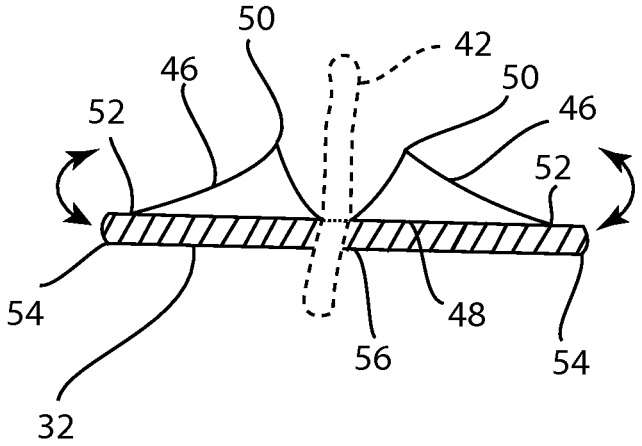
FIG. 10E is a cross-section of the locking mechanism in the unlocked position taken along the line 10E-10E of FIG. 10D and in the direction generally indicated.

In the preferred embodiment, the locking mechanism 32 is generally dome-shaped and flexible to be compressed manually. As shown in FIGS. 10B-10E, the locking mechanism 32 transitions between the locked position (FIG. 10C) and an unlocked position (FIG. 10E) by compressing and decompressing a top portion 56 of the locking mechanism inwardly and outwardly, causing flexing from a convex to a concave orientation of the top portion 56. More specifically, when the top portion 56 of the locking mechanism 32 is compressed inwardly toward the inner surface 48 of the locking mechanism, the dome-shaped mechanism becomes generally flat and the first ends 50 flare outwardly to unlock or release the string 42 (FIGS. 10D and 10E). Conversely, for locking the string 42 at a desired length, the top portion 56 of the locking mechanism 32 is decompressed outwardly, and the locking mechanism 32 resiliently returns to its original dome shape, thereby locking or securely holding the string under the compression force of the first ends 50 (FIGS. 10B and 10C).

Figure 10F:
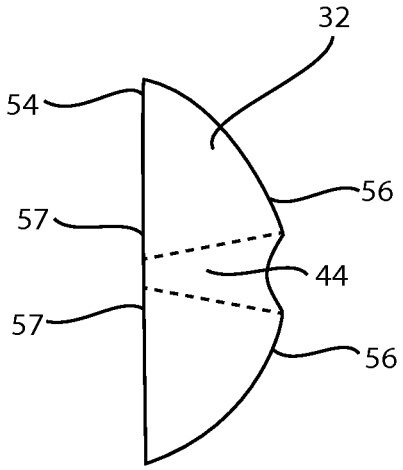
Figure 10G:
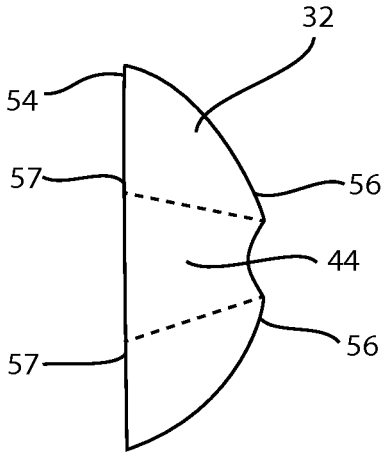

Referring now to FIGS. 10E-10G, other suitable variations of the locking mechanism 32 are shown. It is contemplated that the opening 44 has a larger diameter near the top portion 56 than the diameter near an opposite bottom portion 57 (FIG. 10F). Conversely, it is also contemplated that the opening 44 has a larger diameter near the opposite bottom portion 57 than the diameter near the top portion 56 (FIG. 10G). Accordingly, the locking mechanism 32 operates without the protrusion sections 46.

Figure 10H:
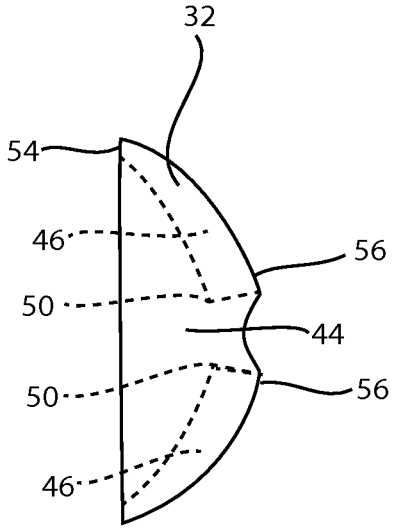
Figure 10I:
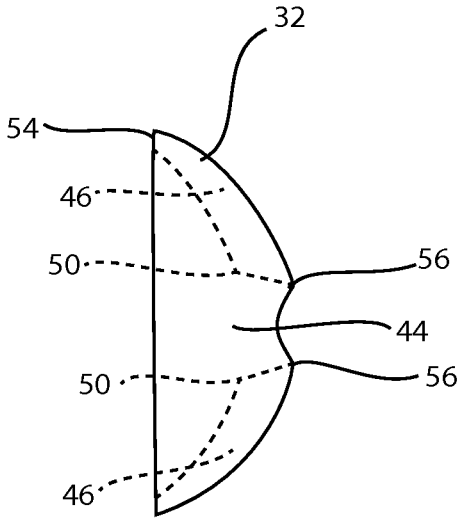

Referring now to FIGS. 10H-10I, when the locking mechanism 32 is provided with the protrusion sections 46, similar suitable variations of the locking mechanism 32 are contemplated. For example, it is contemplated that the opening 44 has a larger diameter near the top portion 56 than the diameter near the opposite first end 50 of the protrusion section 46 (FIG. 10H). Conversely, it is also contemplated that the opening 44 has a larger diameter near the opposite first end 50 than the diameter near the top portion 56 (FIG. 10I).

Figure 11A:
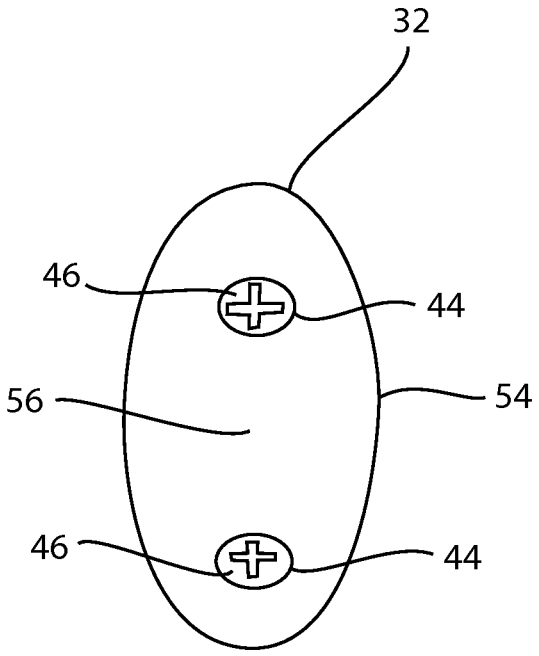
FIGS. 11A-11B illustrate another embodiment of the locking mechanism of FIG. 9 having two openings.
Figure 11B:
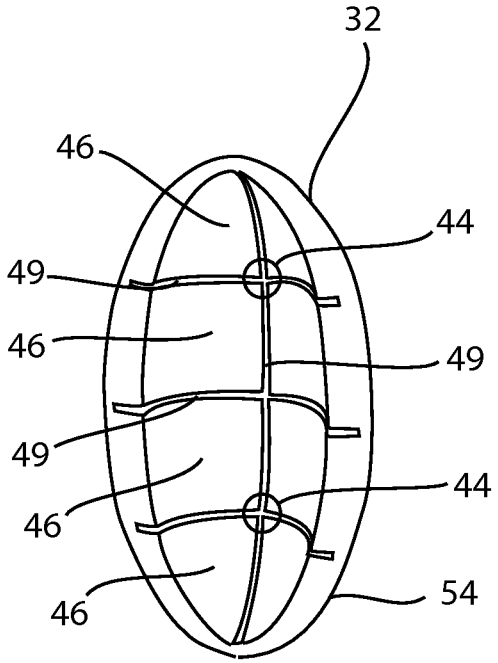

Referring now to FIGS. 11A and 11B, an exemplary variation of the locking mechanism 32 is illustrated. In this example, the locking mechanism 32 has two central openings 44 dimensioned for receiving two separate strings 42, and the periphery 54 of the dome portion of the mechanism 32 has substantially an oval shape in a longitudinal direction. Other suitable shapes are also contemplated to suit the application. Further, the protrusion sections 46 have both generally triangular and quadrilateral shapes (FIG. 11B). Likewise, other suitable geometric shapes are contemplated depending on the application.

Figure 12:
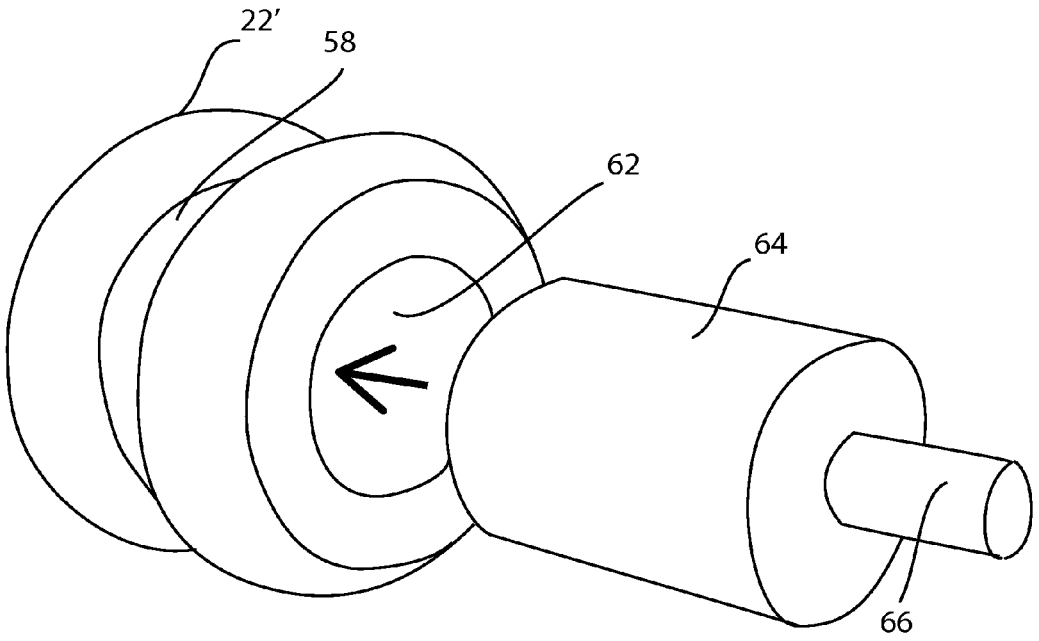
FIG. 12 is an exploded view of the insert portion having optional exemplary accessories.

Referring now to FIGS. 9A, 12, 13A and 13B, an exemplary variation of the insert 22' is illustrated. In this embodiment, the insert 22' has a generally cylindrical shape, and includes at least one circular groove 58 formed on an outer surface of the insert 22' transverse to a longitudinal axis of the insert, such that each groove matingly rests, in a complementary fashion, on the apex of one of a plurality of ripples or protrusions 60 disposed on an inner surface of the corresponding cavity 18. Although the cubical shape is shown in FIG. 5 and the cylindrical shape is shown in FIG. 12 for the inserts 22, 22', other suitable shapes are contemplated to suit the application. Further, any combinations of inserts having different shapes may be utilized with the grooves 58 depending on the user's needs and preferences.

Also included in the insert 22' is a central opening 62 (FIG. 12) dimensioned for accommodating insertion of an auxiliary insert 64, wherein the auxiliary insert is provided for varying a density of the insert 22'. For example, when the auxiliary insert 22' is slidably inserted into the central opening 62 of the insert 22', depending on the density of the auxiliary insert, the support device 30 may exhibit different cushiness and flexibility for the user. Various other suitable types of auxiliary insert 64 are contemplated to suit the application. Optionally, an accessary device 66, such as a vibrator, an alarm clock, a compact radio, and the like, is insertable in the auxiliary insert 64 or the insert 22' to suit the application. For example, the alarm clock 62 wakes up the user after a predetermined time period.

Figure 13A:
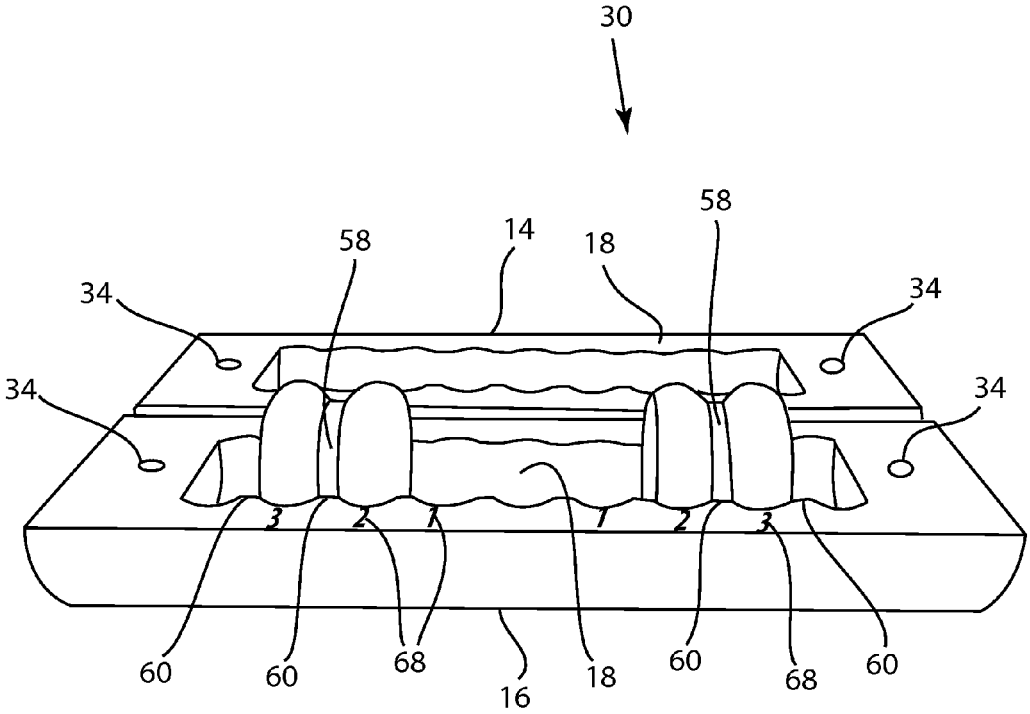
FIGS. 13A-13B illustrate possible placement of the two insert portions of FIG. 12 when the support device is in the open position.
Figure 13B:
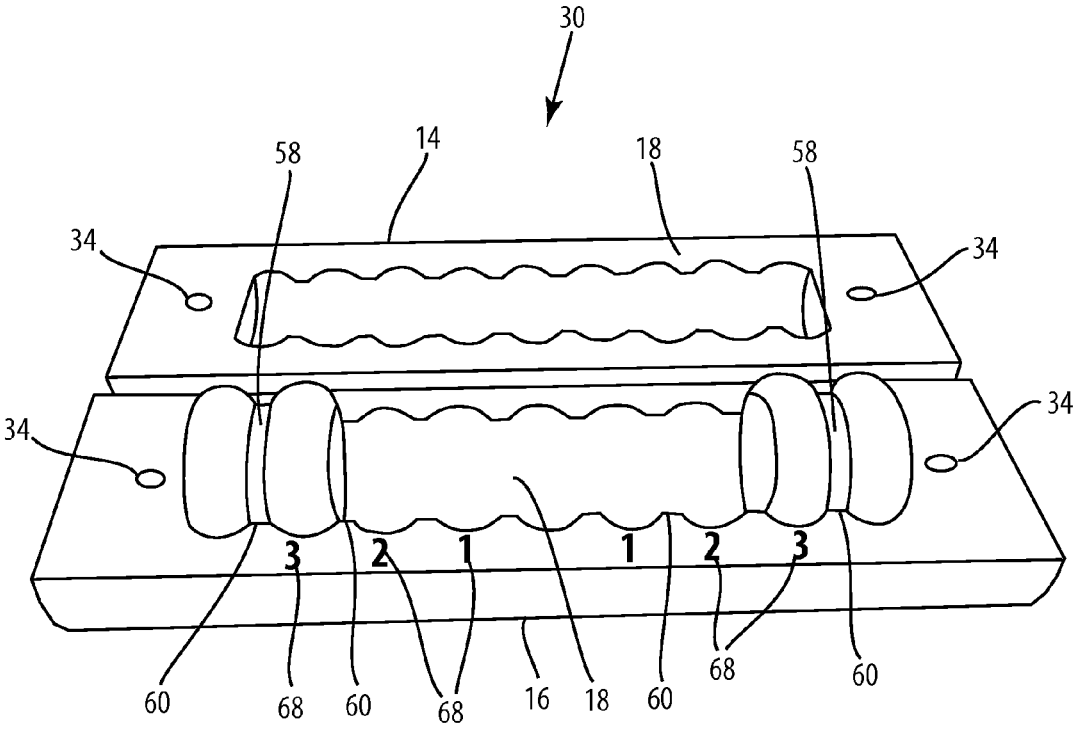

Referring now to FIGS. 13A and 13B, it is preferred that a plurality of measurement indicators 68 are disposed on the inner surface 20 of at least one of the body portions 14, 16 in a longitudinal direction for more accurately placing the inserts 22' in the cavity 18. The measurement indicators 68 are preferably comprised of a grid that is imprinted along the side of the inner cavity 18, but other suitable methods known in the art are also contemplated. The measurement indicators 68 are optionally printed on materials such as felt, fabrics, and similar materials that can be adhered or affixed to the body portions 14, 16.

Thus, the inserts 22' are positioned and re-positioned more easily using the measurement indicators 68. It is contemplated that the inserts 22' are attached to the defined cavity 18, using hook and loop fasteners, but other suitable methods known in the art, such as snap fasteners, are contemplated depending on different applications. It is preferred that the inserts 22, 22' are made of polyurethane foam, or other similar materials that are configurable to matingly fit the cavity 18 of the corresponding body portion 14, 16.

Figure 14:
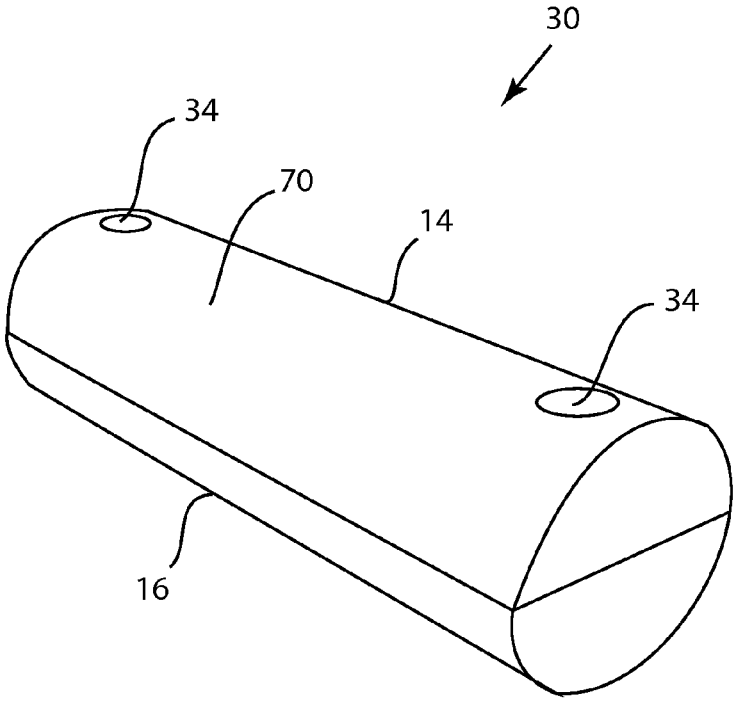
FIG. 14 is a top perspective view of the support device of FIG. 9 in the closed position.
Figure 15:
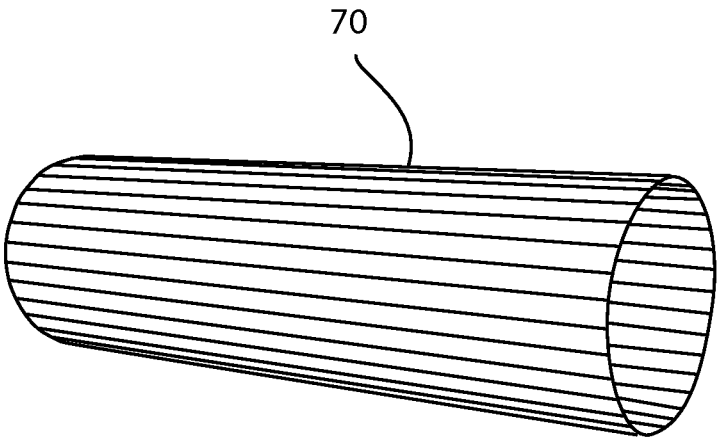
FIG. 15 is a side perspective view of an exemplary outer layer of the support device.
Figure 16:
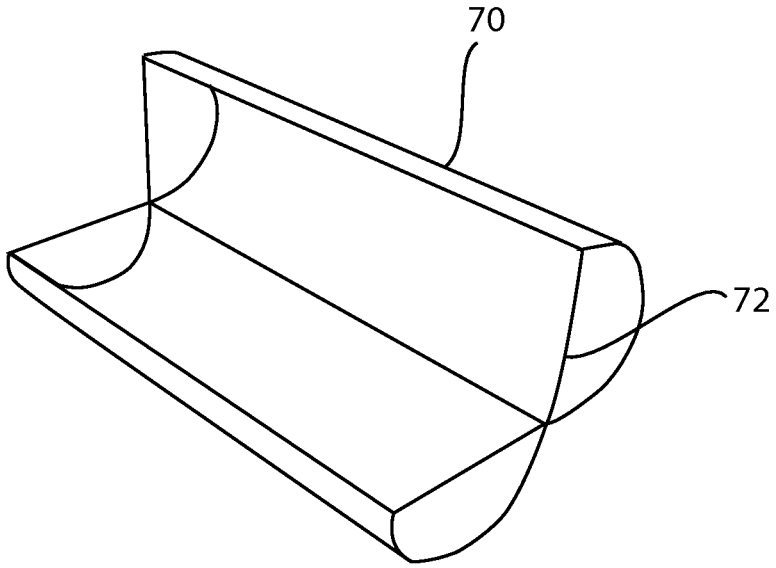
FIG. 16 is a top perspective view of an exemplary carrying case having a zipper closure constructed and arranged for accommodating the support device.

Referring now to FIGS. 14-16, other embodiments include a cover 70 for the support device 10, 30. It is contemplated that at least one of the body portions 14, 16 is spray coated with vinyl-based coating to serve as the cover (FIG. 14). In another embodiment, the cover 70 is made of vinyl or other suitable types of fabric that is filled with buckwheat or other similar materials to keep the head and neck areas of the user cooler (FIG. 15). In FIG. 15, the cover 70 may be a mesh-type elastic net for holding the body portions 14, 16 together during use, and may enhance ventilation around the device 10, 30. In yet another embodiment, the cover 70 is fastened around the body portions 14, 16, using zippers or hook and loop fasteners 72 (FIG. 16). Other suitable fasteners known in the art, such as magnets or snap fasteners, are also contemplated.

The matter set forth in the foregoing description and accompanying drawings is offered by way of illustration only and not as a limitation. While a particular embodiment of the present support device has been described herein, it will be appreciated by those skilled in the art that changes and modifications may be made thereto without departing from the present disclosure in its broader aspects and as set forth in the following claims.

What is claimed is:

1. A support device comprising:

a substantially cylindrical body having a first elongated body portion and a second elongated body portion, each body portion having a generally semi-cylindrical shape, interfacing along a longitudinal plane; and an inner cavity being disposed on an inner surface of each of the first and second body portions, and being dimensioned for receiving at least one removable and adjustable insert, each insert being adjustable and positionable for conforming to a profile of a body of a user, wherein the at least one adjustable insert is movable within the cavity for altering the support of the cylindrical body for the user, and wherein the first and second body portions are removably attached together using a fastening mechanism, such that the body portions are interfaced along the longitudinal plane defined by the inner surfaces of the corresponding body portions.

2. The support device of claim 1, wherein the first and second body portions are attached together at a common connection seam, such that the first and second body portions are rotatable with respect to each other.

3. The support device of claim 1, wherein the first and second body portions are constructed and arranged for changing a general shape or resilience of the device of the space defined by the cavity when the support device is compressed.

4. The support device of claim 1, wherein at least one locking mechanism, transitioning between a locked position and an unlocked position, is provided for securely holding the first and second body portions together.

5. The support device of claim 4, wherein the locking mechanism has at least one opening dimensioned for receiving a string.

6. The support device of claim 5, wherein the locking mechanism has a plurality of protrusion sections on an inner surface of the locking mechanism for locking and unlocking the string depending on the position.

7. The support device of claim 6, wherein the protrusion sections are separated and surrounded by one or more channels.

8. The support device of claim 6, wherein each protrusion section has a first end adjacent the opening, and an opposite second end adjacent a peripheral edge of the locking mechanism.

9. The support device of claim 8, wherein the first end has a thickness being greater than that of the second end.

10. The support device of claim 8, wherein the first end extends from an inner surface of the locking mechanism near the opening toward a central axis of the opening, such that the first ends of the protrusion sections jointly compress toward the central axis of the opening and securely hold the string.

11. The support device of claim 4, wherein the locking mechanism transitions between the locked position and the unlocked position by compressing and decompressing a top portion of the locking mechanism inwardly and outwardly.

12. The support device of claim 4, wherein at least one insertion opening being generally perpendicular to a longitudinal axis of the support device is located on an outer surface of each body portion, and is dimensioned for accommodating insertion of the locking mechanism into the corresponding body portion.

13. The support device of claim 12, wherein each insertion opening has a first chamber and a second chamber, and a diameter of the first chamber is larger than the diameter of the second chamber.

14. The support device of claim 13, wherein the diameter of the second chamber is smaller than the diameter of the locking mechanism, such that the locking mechanism is stopped at a bottom wall of the first chamber.

15. The support device of claim 1, wherein the insert has a generally cylindrical shape, and includes at least one circular groove formed on an outer surface of the insert transverse to a longitudinal axis of the insert.

16. The support device of claim 15, wherein the at least one groove matingly rests, in a complementary fashion, on the apex of one of a plurality of ripples disposed on an inner surface of the corresponding cavity.

17. The support device of claim 1, wherein the at least one insert has a central opening dimensioned for accommodating insertion of an auxiliary insert.

18. The support device of claim 1, further comprising an accessary device being insertable in a corresponding opening of at least one of: an auxiliary insert, the at least one insert, and the support device.

19. The support device of claim 1, further comprising a cover including a mesh-type elastic net for holding the support device and enhancing ventilation around the support device.

20. A support device comprising:

a substantially cylindrical body having a first elongated body portion and a second elongated body portion, each body portion having a generally semi-cylindrical shape, interfacing along a longitudinal plane; and an inner cavity being disposed on an inner surface of each of the first and second body portions, and being dimensioned for receiving at least one removable and adjustable insert, each insert being adjustable and positionable for conforming to a profile of a body of a user, wherein the at least one adjustable insert is movable within the cavity for altering the support of the cylindrical body for the user, and wherein a plurality of measurement indicators are disposed on the inner surface of at least one of the body portions in a longitudinal direction for more accurately placing the inserts in the cavity.

21. The support device of claim 20, further comprising an accessary device being insertable in a corresponding opening of at least one of: an auxiliary insert, the at least one insert, and the support device.

22. The support device of claim 20, further comprising a cover including a mesh-type elastic net for holding the support device and enhancing ventilation around the support device.

23. A support device comprising:

a substantially cylindrical body having a first elongated body portion and a second elongated body portion, each body portion having a generally semi-cylindrical shape, interfacing along a longitudinal plane; and an inner cavity being disposed on an inner surface of the corresponding body portion, and being dimensioned for receiving at least one removable and adjustable insert, each insert being adjustable and positionable for conforming to a profile of a body of a user, wherein the at least one adjustable insert is movable within the cavity for altering the support of the cylindrical body for the user, and the at least one insert has a central opening dimensioned for accommodating insertion of an auxiliary insert.

24. The support device of claim 23, further comprising an accessary device being insertable in a corresponding opening of at least one of: the auxiliary insert, the at least one insert, and the support device.

25. The support device of claim 23, further comprising a cover including a mesh-type elastic net for holding the support device and enhancing ventilation around the support device.

* * * * *